US006694032B2

(12) United States Patent
Yun et al.

(10) Patent No.: US 6,694,032 B2
(45) Date of Patent: Feb. 17, 2004

(54) ELECTRET CONDENSER MICROPHONE

(75) Inventors: Du-Yeong Yun, Inchon (KR); Sung-Ho Park, Inchon (KR)

(73) Assignee: BSE Co., Ltd., Keiyang-ku (KR)

( * ) Notice: Subject to any disclaimer, the term of this patent is extended or adjusted under 35 U.S.C. 154(b) by 218 days.

(21) Appl. No.: 10/019,887

(22) PCT Filed: Oct. 31, 2001

(86) PCT No.: PCT/KR01/01836

§ 371 (c)(1),
(2), (4) Date: Dec. 27, 2001

(87) PCT Pub. No.: WO02/37893

PCT Pub. Date: May 10, 2002

(65) Prior Publication Data

US 2003/0007655 A1 Jan. 9, 2003

(51) Int. Cl.[7] ..... H04R 25/00

(52) U.S. Cl. ..... 381/174; 307/400; 600/25; 29/594; 29/25.41; 361/283.1; 367/170; 367/181; 381/152; 381/174; 381/191

(58) Field of Search ..... 381/152, 361, 381/174, 87, 191, 113, 345, 344, 353, 369, 178, 354, 355, 175; 307/400; 600/25; 29/25.41, 594, 595, 847, 886; 361/283.4, 283.1, 283.3; 367/170, 181, 173, 174

(56) References Cited

U.S. PATENT DOCUMENTS 4,188,513 A * 2/1980 Morrell
4,236,051 A * 11/1980 Nakagawa
4,249,043 A * 2/1981 Morgan
4,281,222 A * 7/1981 Nakagawa
4,456,796 A * 6/1984 Nakagawa
4,492,825 A * 1/1985 Brzezinski
4,730,283 A * 3/1988 Carlson
4,764,690 A * 8/1988 Murphy
4,891,843 A * 1/1990 Paulus
4,910,840 A * 3/1990 Sprenkels
5,101,543 A * 4/1992 Cote
5,408,731 A * 4/1995 Berggvist
5,881,158 A * 3/1999 Lesinski
6,243,474 B1 * 6/2001 Tai
6,479,878 B1 * 11/2002 Okawa

* cited by examiner

*Primary Examiner*—Curtis Kuntz
*Assistant Examiner*—Dionne Harvey
(74) *Attorney, Agent, or Firm*—F. Chau & Associates, LLC

(57) ABSTRACT

The present invention relates to an electret condenser microphone including the vibratory diaphragm which is comprised of an electret film into which an electric charge is charged; a conductive film formed on one side of the electret film and a polar ring disposed at a peripheral edge of the underside of the conductive film. Also, this microphone includes a vibratory diaphragm support member which is disposed on the vibratory diaphragm and has a concave groove and a concave portion. On the vibratory diaphragm support member is attached an integrated circuit serving to receive and amplify a transformed electrical signal from the vibratory diaphragm.

5 Claims, 6 Drawing Sheets

ELECTRET CONDENSER MICROPHONE

TECHNICAL FIELD

The present invention relates generally to a hybrid-type electret condenser microphone, and more particularly to a miniaturized electret condenser microphone for use in portable telephones or information communication devices, in which main components including electronic circuits, such as an IC device and the like, are integrated into a chip.

BACKGROUND ART

Korean Patent Publication No. 1993-3063, which was filed on Dec. 22, 1990 in the name of this applicant and issued on Apr. 17, 1993, discloses an electret condenser microphone which is attached to a mike, a telephone, a portable telephone, a video tape recorder, a toy and the like and serves to transform sound pressure into an electrical signal.

The electret condenser microphone disclosed in this patent is schematically shown in FIG. 1 in a cross section. As shown in FIG. 1, the electret condenser microphone includes a case 3 which has an opening 1 formed at a central portion of an underside thereof and a cover 2 attached to an outer surface thereof. A polar ring 4 and a vibratory diaphragm 5 are disposed within the case 3. An amplifier unit 9 is secured to a printed circuit board 12 by means of a soldering 13. An output lead 11 of the amplifier unit 9 is connected to the printed circuit board 12 by soldering. On the vibratory diaphragm 5 is disposed a fixed electrode 16 which is connected to an input terminal 10 of the amplifier unit 9 and insulated by an insulating ring 17. A dielectric plate 20 applied with an electrostatic material is disposed within the fixed electrode 16. In addition, a plurality of openings 21 are formed at a peripheral edge of the fixed electrode 16.

In the conventional electret condenser microphone having a construction as described above, however, the dielectric plate 20 is separately adhered onto the fixed electrode 16 in a state where the fixed electrode 16 insulated from the case 3 by the insulating ring 17 is connected directly to the vibratory diaphragm 5. For this reason, although the electret condenser microphone can be significantly improved in performance, it has a problem in that it cannot be miniaturized. Another problem is that the contact area between the input terminal 10 of the amplifier unit 9 and the fixed electrode 16 is limited, so that inferior electrical contact occurs between the input terminal 10 of the amplifier unit 9 and the fixed electrode 16 and hence production yield cannot be increased.

DISCLOSURE OF THE INVENTION

Accordingly, the present invention has been made to solve the above-mentioned problems occurring in the prior art, and an object of the present invention is to provide an electret condenser microphone which can be miniaturized.

It is another object of the present invention to provide an electret condenser microphone which can be manufactured in increased yield.

To accomplish the above objects, the present invention provides an electret condenser microphone which comprises: a case which is electrically grounded and has an opening formed at an upper side thereof and a plurality of sound holes formed at a central portion thereof, the sound holes serving to collect and pass sound there-through; a vibratory diaphragm which is disposed within the case in parallel to an inner bottom surface of the case, apart from the bottom surface of the case at a given distance ($\Delta t$), and which is vibrated by sound pressure coming in through the sound holes of the case so as to transform a sound signal into an electrical signal; a vibratory diaphragm support member which is disposed on the vibratory diaphragm and has a concave groove formed at an outer surface thereof and a concave portion, the concave groove being formed such that the vibratory diaphragm is spaced apart from the vibratory diaphragm support member at a given distance, the concave portion having a plurality of small sound holes formed at a bottom surface thereof such that the vibratory diaphragm is easily vibrated; an integrated circuit which is attached to the vibratory diaphragm support member and serves to amplify the electrical signal; an insulating cap which covers the opening formed at the upper side of the case while electrically insulating the vibratory diaphragm support member from the case; a first contact pin which is disposed on the insulating cap such that it receives the amplified signal from the integrated circuit attached on the vibratory diaphragm support member through a contact element connected by a lead to the integrated circuit and transmits the received signal to the outside of the electret condenser microphone; and a second contact pin which is disposed on the insulating cap such that it receives the amplified signal from the integrated circuit attached to the vibratory diaphragm support member through a contact element connected by a lead to the integrated circuit and transmit the received signal to the outside of the electret condenser microphone.

BEST MODE FOR CARRYING OUT THE INVENTION

Hereinafter, the electret condenser microphone according to a preferred embodiment of the present invention will be described with reference to the accompanying drawings.

Figure 1:
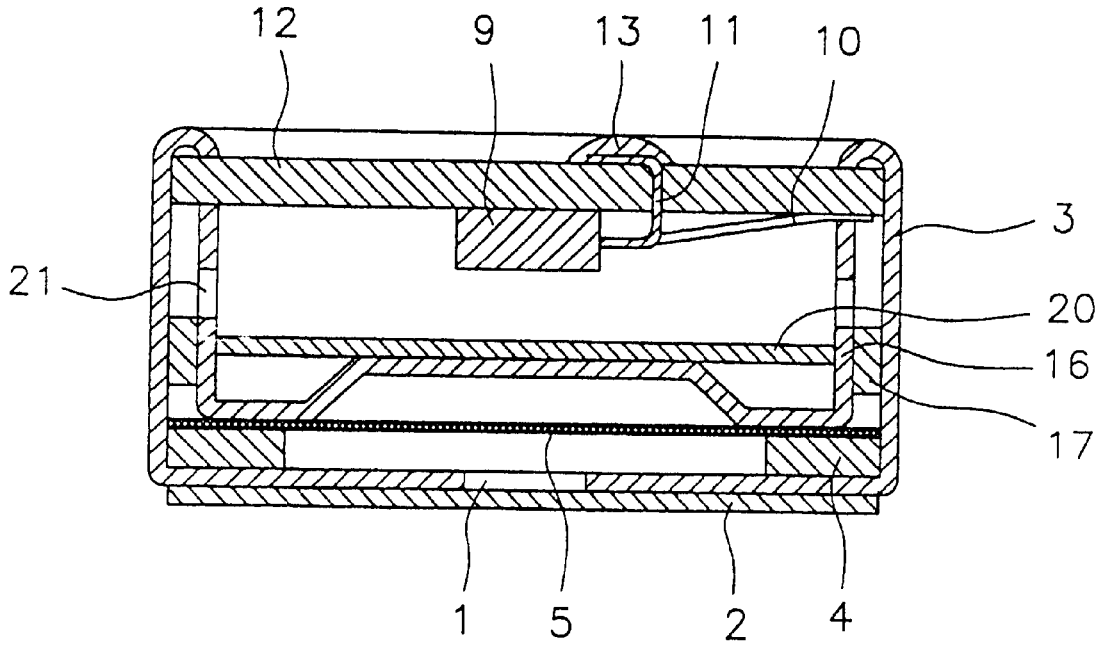
FIG. 1 is a cross-sectional view which schematically shows an electret condenser microphone of the prior art.
Figure 2:
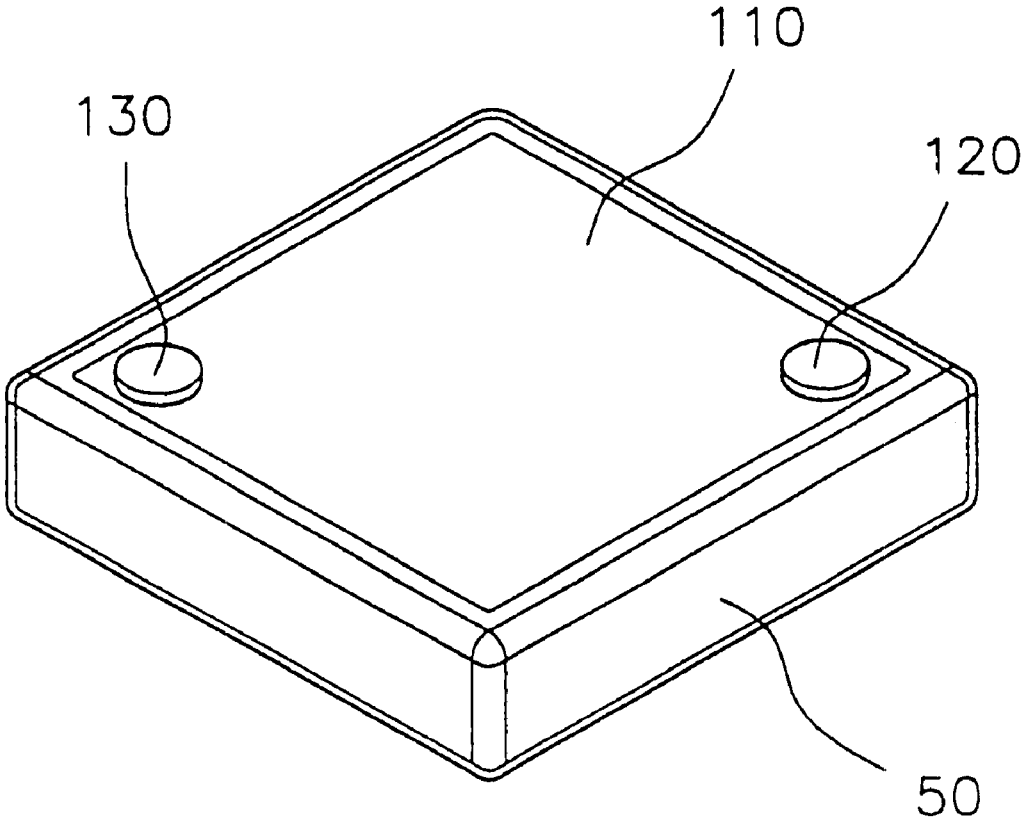
FIG. 2 is a perspective view which schematically shows the appearance of an electret condenser microphone according to a preferred embodiment of the present invention.
Figure 3:
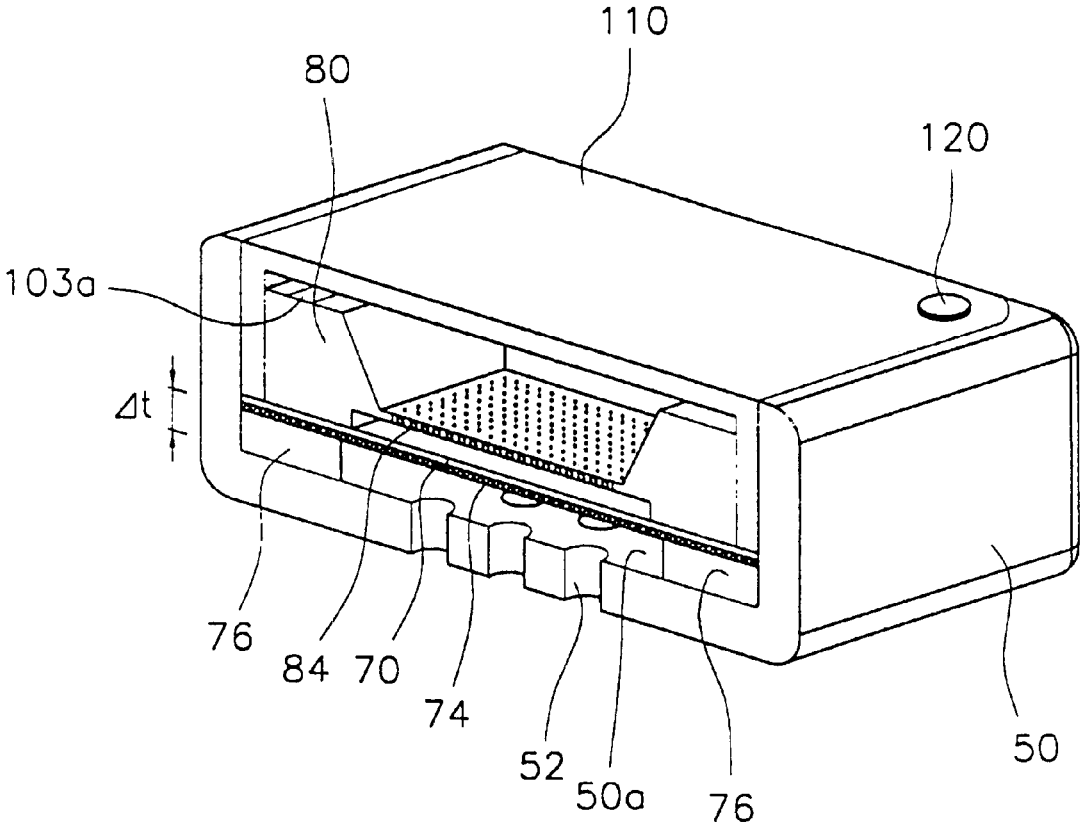
FIG. 3 is a partial cross-sectional view showing the electret condenser microphone according to a preferred embodiment of the present invention.
Figure 4:
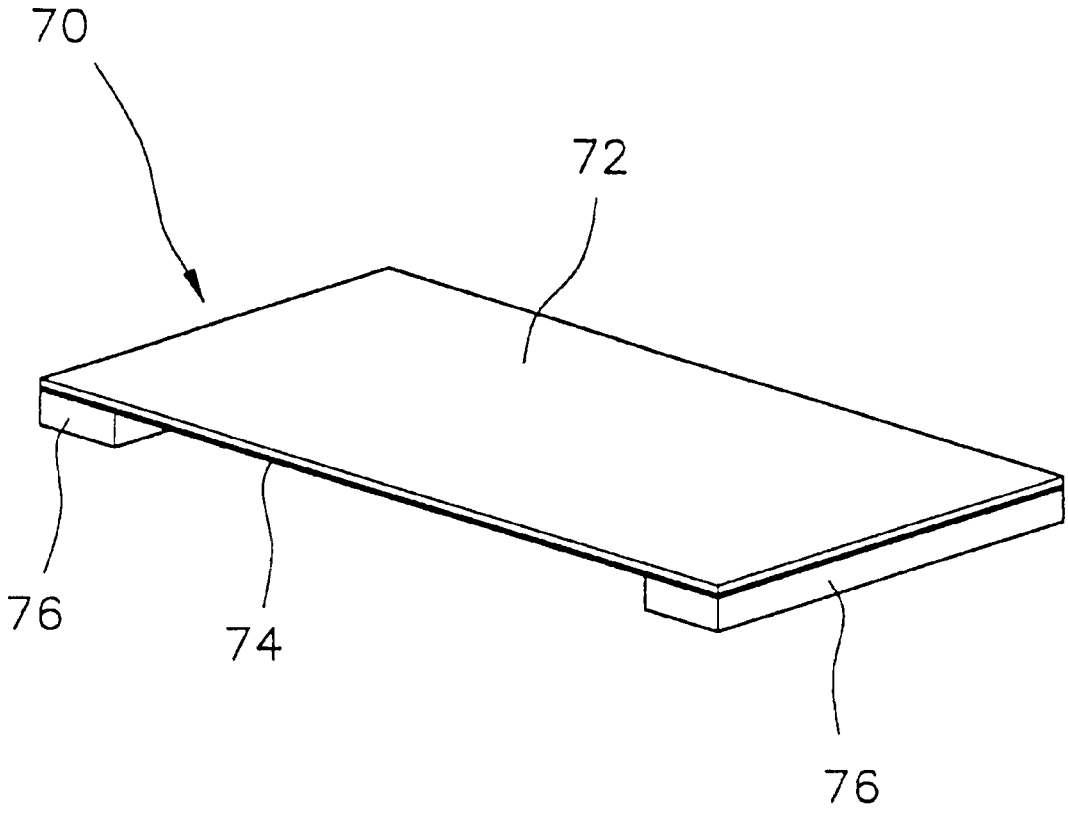
FIG. 4 is a perspective view which schematically shows a vibratory diaphragm used in the electret condenser microphone according to a preferred embodiment of the present invention.
Figure 5:
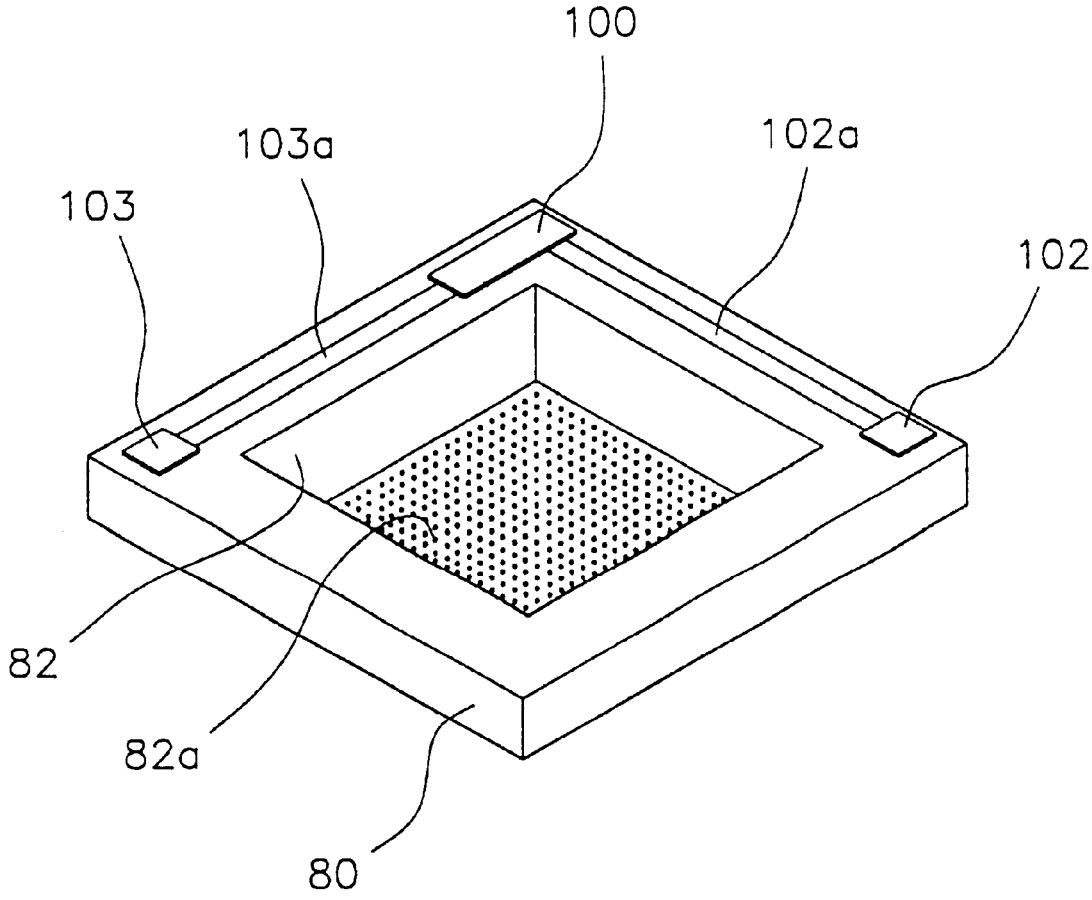
FIG. 5 is a perspective view which shows a silicon securing board in which an IC device used in the electret condenser microphone according to a preferred embodiment of the present invention is integrated into a chip.

FIG. 2 is a perspective view which schematically shows the appearance of an electret condenser microphone according to a preferred embodiment of the present invention; FIG. 3 is a partial cross-sectional view showing an electret condenser microphone according to a preferred embodiment of the present invention; FIG. 4 is a perspective view which schematically shows a vibratory diaphragm used in an electret condenser microphone according to a preferred embodiment of the present invention; and FIG. 5 is a perspective view which shows a silicon securing board in which an IC device used in an electret condenser microphone according to a preferred embodiment of the present invention is integrated into a chip.

Referring to FIGS. 2 to 5, an electret condenser microphone according to a preferred embodiment of the present invention includes a case 50 and a vibratory diaphragm 70 which is vibrated by sound pressure coming in through sound holes 52 of the case 50 so as to transform a sound signal into an electrical signal.

On the vibratory diaphragm 70 is disposed a vibratory diaphragm support member 80 made of a semiconductor wafer which has a concave portion 82.

A plurality of small sound holes 82*a* are formed at a bottom surface of the concave portion 82 so that the vibratory diaphragm 70 is easily vibrated.

Moreover, the electret condenser microphone includes an integrated circuit 100 which receives and amplifies the transformed electrical signal from the vibratory diaphragm 70.

Also, the electret condenser microphone has an insulating cap 110 which covers an opening formed at the upper side of the case 50 while serving to electrically insulate the vibratory diaphragm support member 80 from the case 50.

Further, the electret condenser microphone includes a pair of contact pins 120 and 130 disposed on the insulating cap 110.

In this case, the first contact pin 120 is connected to a contact element 102 connected to a lead 102*a* of the integrated circuit 100, such that the amplified signal from the integrated circuit 100 attached on the vibratory diaphragm member 80 is transmitted to the outside of the electret condenser microphone. The second contact pin 130 is connected to a contact element 103 which is connected to a lead 103*a* of the integrated circuit 100.

In other words, the case 50 included in the electret condenser microphone according to the present invention has an opening formed at the upper side thereof, and a plurality of sound holes 52 formed at a central portion of the underside thereof. The sound holes 52 serve to collect and pass sound there-through. Within the case 50, the vibratory diaphragm 70 is disposed parallel to an inner bottom surface 50*a* of the case while maintaining a given distance (Δt) there-between.

Furthermore, the vibratory diaphragm support member 80 is made of a semiconductor wafer and has the concave portion 82. A plurality of small sound holes 82*a* are formed at a bottom surface of the concave portion 82 of the vibratory diaphragm support member 80, so that the vibratory diaphragm 70 is vibrated easily. The vibratory diaphragm support member 80 also has a concave groove 84 formed at the underside thereof to a depth of generally 5 to 25 μm, so that the vibratory diaphragm 70 is spaced apart from the vibratory diaphragm support member 80 at a given distance.

In the electret condenser microphone of the present invention, since the vibratory diaphragm support member 80 is made of a semiconductor wafer, the integrated circuit 100 for amplifying the transformed electrical signal from the vibratory diaphragm 70 can be made into a single chip.

The opening formed at the upper side of the case 50 is covered with the insulating cap 110 which serves to electrically insulate the vibratory diaphragm support member 80 from the case 50.

On the insulating cap 110, the first contact pin 120 is disposed, which receives the amplified signal from the integrated circuit 100 through the contact element 102 connected to the integrated circuit 100 by the lead 102 and transmits the received signal to the outside of the electret condenser microphone.

Moreover, on the insulating cap 110, the second contact pin 130 is disposed, which is electrically connected to the contact element 103 that is connected to the integrated circuit 100 by the lead 103*a*. The second contact pin 130 can be electrically connected to the outside of the electret condenser microphone.

As shown in FIG. 4 in detail, the vibratory diaphragm 70 comprises an electret film 72 into which an electric charge is charged; a conductive film 74 which is formed on one side of the electret film 72 by sputtering or chemical vapor deposition (CVD); and a polar ring 76 which is disposed at a peripheral edge of the underside of the conductive film 74 such that the conductive film 74 formed on the electret film 72 is located apart from the inner surface 50*a* of the case 50 at a given distance (Δt).

Preferably, the vibratory diaphragm 70 is formed of 12.5 to 25 μm thick fluoro ethylene propylene(FEP) or Teflon.

Figure 6:
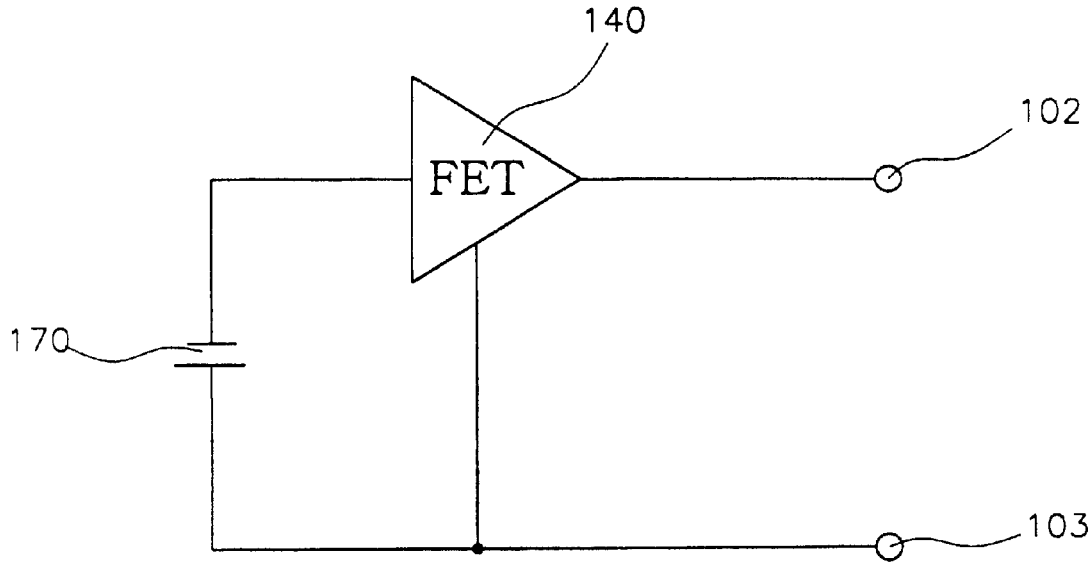
FIG. 6 is a schematic view of an integrated circuit shown in FIG. 5.

As shown in FIG. 6, the integrated circuit 100 comprises an amplifier 104 which serves to transform a voltage signal generated by vibration of the vibratory diaphragm caused by sound pressure into a current signal and to amplify the transformed current signal. Such an amplifier 104 is comprised of a field effect transistor (FET) 140 for a microphone and a capacitor 170 for a noise filter. In the field effect transistor, a gate terminal is connected to the vibratory diaphragm support member 80, a drain terminal is connected to the contact element 102, and a source terminal is connected to the contact element 103.

In this case, it is preferred that the vibratory diaphragm support member 80 is formed of a silicon or germanium wafer and made conductive by suitable doping of impurities.

At the bottom surface of the concave portion 82 of the vibratory diaphragm support member 80, a plurality of sound holes 82*a* are formed respectively so as to have a diameter of 20 to 100 μm by etching firstly using an anisotropic etching method and then etching the resulting bottom surface secondarily.

Hereinafter, operations and effects of the electret condenser microphone according to the preferred embodiment of the present invention will be described.

First, an assembling process of the electret condenser microphone according to the preferred embodiment of the present invention will now be described.

In the assembling process, the vibratory diaphragm 70 comprising the electret film 72, the conductive film 74 formed of a metal on one side of the electret film 72, and the polar ring 76 which is disposed on the peripheral edge of the underside of the conductive film 74 in such a manner that the conductive film 74 is located apart from the inner bottom surface 50*a* of the case 50 at a given distance (Δt) and maintained under a desired tension, is disposed on the inner bottom surface 50*a* of the case 50 in such a manner that the polar ring 76 faces downward.

Next, the vibratory diaphragm support member 80 having the integrated circuit 100 attached thereon is mounted onto the vibratory diaphragm 70. Then, the vibratory diaphragm 70 is spaced apart from the underside of the concave portion 82 formed at the vibratory diaphragm support member 80 at a given distance by virtue of the concave groove 84 formed at the underside of the vibratory diaphragm support member 80.

Thereafter, the opening of the case 50 is covered with the insulating cap 110. Then, a sidewall of the insulating cap 110 is in contact with the underside of the vibratory diaphragm support member 80 and an inner sidewall of the case 50, so that the vibratory diaphragm support member is electrically insulated from the case 50.

At this time, the first contact pin 120 disposed on the insulating cap 110 is electrically connected to the contact element 102 attached on the vibratory diaphragm support member 80, and the second contact pin 130 disposed on the insulating cap 110 is electrically connected to the contact element 103 attached on the vibratory diaphragm support member 80.

In this assembled state, the vibratory diaphragm 70 is disposed on the inner bottom surface 50*a* of the case 50 in such a manner that it is spaced apart from the inner bottom surface 50*a* of the case 50 at a given distance (Δt) by interposition of the polar ring 76 there-between.

Also, on the vibratory diaphragm 70 is disposed the vibratory diaphragm support member 80 on which the integrated circuit 100 is attached.

In this state, since the concave groove 84 is formed at the underside of the vibratory diaphragm support member 80, and the sound holes 82*a* are formed at the bottom surface of the concave portion 82 of the vibratory diaphragm support member 80, the vibratory diaphragm 70 is easily vibrated by sound pressure coming in through the sound holes 52 of the case 50.

While the vibratory diaphragm 70 is vibrated by sound pressure, a sound signal is transformed into a voltage signal. This voltage signal is applied to the field effect transistor (FET) 140 within the integrated circuit 100 through the vibratory diaphragm support member 80. In this case, the vibratory diaphragm support member 80 is connected to the gate terminal of the field effect transistor, which serves to transform the voltage signal into a current signal and amplify the transformed current signal.

In the field effect transistor of the amplifier 104, the voltage signal transmitted from the vibratory diaphragm support member 80 is transformed into the current signal and amplified.

Then, noise is removed from the amplified signal in the capacitor 170, and the amplified signal is transmitted to the outside of the electret condenser microphone through the leads 102*a* and 103*a* and the contact elements 102 and 103.

In this state, the contact element 102 is connected to the drain terminal of the field effect transistor, and the contact element 103 is connected to the source terminal of the field effect transistor.

Furthermore, the electrical signal which was transformed from sound and amplified in the integrated circuit 100 is outputted to a telephone, a video tape recorder or a toy through contact pins 120 and 130, which are in contact with the contact elements 102 and 103, respectively.

In the embodiment described above, although the case 50 of the electret condenser microphone has been described illustratively as it is designed in a rectangular shape, it is understood that this invention is not limited thereto, and forming the case 50 so as to have various shapes, such as a circular shape or a polygonal shape, belongs to the concept of the present invention.

Although a preferred embodiment of the present invention has been described for illustrative purposes, those skilled in the art will appreciate that various modifications, additions and substitutions are possible, without departing from the scope and spirit of the invention as disclosed in the accompanying claims.

As apparent from the foregoing, the electret condenser microphone has a simple structure comprising the case, the vibratory diaphragm, the vibratory diaphragm support member having the integrated circuit attached thereto, and a pair of the contact pins, so that it can be miniaturized.

Furthermore, by virtue of a decrease in number of the assembling processes, it can be manufactured at increased yields and thus reduce cost.

In addition, in the electret condenser microphone of the present invention, since the vibratory diaphragm support member, which serves to support the vibratory diaphragm in such a manner that the vibratory diaphragm is easily vibrated and also serves to transmit the signal from the vibratory diaphragm, is made of a semiconductor wafer, the electrical contact is satisfactory, and the circuit can be made directly on the semiconductor wafer whereby it can easily be integrated into a chip.

What is claimed is:

1. An electret condenser microphone comprising:

a case 50 having an opening formed at a upper side thereof and a plurality of sound holes 52 formed at a central portion of a underside thereof, the sound holes 52 serving to collect and pass sound there-through;

a vibratory diaphragm 70 disposed above an inner bottom surface 50*a* of the case 50 and spaced from the inner bottom surface 50*a* of the case 50 at a given distance (Δt), the vibratory diaphragm 70 being vibrated by sound pressure coming in through the sound holes 52 of the case 50 so as to transform a sound signal into a voltage signal;

a vibratory diaphragm support member 80 formed of a semiconductor wafer and disposed on the vibratory diaphragm 70, the vibratory diaphragm support member 80 serving to transmit the voltage signal from the vibratory diaphragm 70 and having a concave groove 84 formed at a underside thereof and a concave portion 82 at a upper side thereof, the concave groove 84 being formed such that the vibratory diaphragm support member 80 is spaced apart from at a given distance, the concave portion 82 having a plurality of sound holes 82*a* which are formed at a bottom surface thereof such that the vibratory diaphragm 70 is vibrated easily;

an integrated circuit 100 attached to the vibratory diaphragm support member 80 and serving to transform the voltage signal into an electrical signal and amplify the transformed electrical signal;

an insulating cap 110 covering the opening formed on the case 50 while electrically insulating the vibratory diaphragm support member 80 from the case 50; and, a pair of contact pins 120 and 130 disposed on the insulating cap 110 and serving to transmit amplified electrical signal from the integrated circuit 100 to an outside of the electret condenser microphone.

2. The electret condenser microphone according to claim 1, in which the vibratory diaphragm 70 comprises an electret film 72 into which electric charge is charged; a conductive film 74 formed on one side of the electret film 72 by sputtering or chemical vapor deposition (CVD); and a polar ring 76 disposed at a peripheral edge portion of an underside of the conductive film 74 such that the conductive film 74 formed on the electret film 72 is located apart from the inner bottom surface 50*a* of the case 50 at a given distance (Δt).

3. The electret condenser microphone according to claim 1, in which the vibratory diaphragm 70 is formed of 12.5 to 25 $\mu$m thick fluoro ethylene propylene(FEP) or Teflon.

4. The electret condenser microphone according to claim 1, in which the concave groove 84 formed at the underside of the vibratory diaphragm support member 80, has a depth of 5 to 25 $\mu$m.

5. The electret condenser microphone according to claim 1, in which the integrated circuit 100 is comprised of a field effect transistor for use in a microphone.

* * * * *